US009410278B2

(12) United States Patent
He et al.

(10) Patent No.: US 9,410,278 B2
(45) Date of Patent: Aug. 9, 2016

(54) WASHING MACHINE AND WASHING METHOD

(75) Inventors: Zhengbao He, Qingdao (CN); Chunfeng Lao, Qingdao (CN)

(73) Assignees: HAIER GROUP TECHNIQUE R & D CENTER, Qingdao, Shandong (CN); HAIER GROUP CORPORATION, Qingdao, Shandong (CN)

( * ) Notice: Subject to any disclaimer, the term of this patent is extended or adjusted under 35 U.S.C. 154(b) by 209 days.

(21) Appl. No.: 14/347,785

(22) PCT Filed: May 4, 2012

(86) PCT No.: PCT/CN2012/075076

§ 371 (c)(1), (2), (4) Date: Mar. 27, 2014

(87) PCT Pub. No.: WO2013/044635

PCT Pub. Date: Apr. 4, 2013

(65) Prior Publication Data

US 2014/0230160 A1 Aug. 21, 2014

(30) Foreign Application Priority Data

Sep. 30, 2011 (CN) ..... 2011 1 0293342

(51) Int. Cl.
*D06F 31/00* (2006.01)
*D06F 35/00* (2006.01)
(Continued)

(52) U.S. Cl.
CPC ..... *D06F 39/026* (2013.01); *D06F 31/005* (2013.01); *D06F 35/00* (2013.01); *D06F 37/04* (2013.01); *D06F 37/06* (2013.01)

(58) Field of Classification Search
CPC ..... D06F 31/005; D06F 35/00; D06F 37/04; D06F 39/026
USPC ..... 8/158, 159; 68/29, 139, 140, 142, 143
See application file for complete search history.

(56) References Cited

U.S. PATENT DOCUMENTS 2,312,657 A 6/1941 Locke
3,803,882 A 4/1974 Brennan
(Continued)

FOREIGN PATENT DOCUMENTS

CH 390860 A 4/1965
CN 2073434 U 3/1991
(Continued)

OTHER PUBLICATIONS

European Search Report issued on Mar. 31, 2015 by the European Patent Office, in corresponding European Patent Application No. 12835070.9. (7 pages).
(Continued)

*Primary Examiner* — Michael Barr
*Assistant Examiner* — Levon J Shahinian
(74) *Attorney, Agent, or Firm* — Buchanan Ingersoll & Rooney PC

(57) ABSTRACT

A washing machine and a washing method, comprises an inner cylinder, an outer cylinder, and solid particles as washing medium. The inner cylinder is driven into rotation by a driver device. The inner cylinder has arranged on the inner wall thereof scraper blades that protrude inwards and are bent along the wall of the inner cylinder. The scraper blades drives the particles into obliquely upward or obliquely downward movements and flipping, thus allowing for more fully mixing clothes with the particles, for simplified washing process, while also for improved cleaning rate, and for facilitated recycling of the particles.

13 Claims, 2 Drawing Sheets

(51) Int. Cl.

| | |
|---|---|
| ***D06F 37/04*** | (2006.01) |
| ***D06F 37/06*** | (2006.01) |
| ***D06F 39/02*** | (2006.01) |

(56) References Cited

U.S. PATENT DOCUMENTS

| | | | |
|---|---|---|---|
| 5,093,948 | A | 3/1992 | Val et al. |
| 2009/0038348 | A1 | 2/2009 | Dalla Valle |
| 2009/0165217 | A1 | 7/2009 | Pillsticker |
| 2010/0326142 | A1 | 12/2010 | Geyer et al. |
| 2011/0296628 | A1 | 12/2011 | Jenkins et al. |

FOREIGN PATENT DOCUMENTS

| | | | |
|---|---|---|---|
| CN | 201092620 | Y | 7/2008 |
| CN | 101946035 | A | 1/2011 |
| WO | WO 2010/094959 | A1 | 8/2010 |

OTHER PUBLICATIONS

Office Action issued Oct. 7, 2015, by the U.S. Patent and Trademark Office in co-pending U.S. Appl. No. 14/347,766 (15 pgs).

International Search Report (PCT/ISA/210) mailed on Aug. 16, 2012, by the Chinese Patent Office as the International Searching Authority for International Application No. PCT/CN2012/075076.

WASHING MACHINE AND WASHING METHOD

FIELD OF THE INVENTION

The invention relates to a washing machine, in particular to a washing machine using solid particles in the washing and a washing method, which belongs to the technical field of washing machine.

BACKGROUND OF THE INVENTION

In the washing method of a traditional washing machine, the washing medium is water, adding water and detergents into the washing machine for washing; after washing, discharging the sewage from the washing machine via dewatering function, and then adding clean water again for continuing the washing or rinsing process, finally discharging water after the washing is entirely finished. In this method, the water is simply discharged and then the clean water is refilled, thus causes large water consumption. Meanwhile, lots of chemical substances which are harmful to the environment are contained in the washing liquid and the washing process is time-consuming, with large power consumption each time.

To overcome the shortcomings of the traditional washing machine, a washing method with the specially-made solid particles from the polymer material as the washing medium is provided, in which the dirt on clothes is adsorbed and then removed through the friction between the solid particles and clothes, so as to achieve the purpose of washing. The washing method can save over 80% water. Moreover, the solid particles as washing medium can be recycled and reused with a long service life, having no need to change and being safe and environmentally friendly.

A washing machine that uses the washing method is generally arranged with a storage space of particles as well as a feed opening and a discharge opening on the outer tub. Before washing, the particles is put into the outer tub from the feeding opening, and then recycled back into the storage space of particles fully after washing. During the recovery of the particles, the inner cylinder is rotating with high speed, and the particles are pushed into the storage space by the centrifugal force. If it is in need of dehydration of the particles, the particles is fed recycled again. The structure of the washing machine and the washing method are complex, and the recovery rate of particles 100% can not be guaranteed.

SUMMARY OF THE INVENTION

The main object of the invention is to solve the above problems and the defects, provides a washing machine with simple structure, simplified washing procedures, and improved cleaning efficiency, conducive to recycle the particles.

Another object of the invention is to provide a washing method with simplified washing procedures, improved cleaning efficiency, and conducive to the particles recycling.

In order to realize the above purpose, the technical scheme of the invention is:

A washing machine, comprising an inner cylinder, an outer cylinder, and solid particles as washing medium, the inner cylinder being driven to rotate by a driver device, scraper blades which protrude inwards and are bent along the inner wall of the inner cylinder being arranged on the inner wall of the inner cylinder, the scraper blades driving the particles to move and turn over obliquely upward or downward.

Further, the scraper blades are spirally set from the bottom to the top of the inner cylinder.

Further, a plurality of scraper blades are arranged in parallel, a projected length of the scraper blades along the axial direction of the inner cylinder is equal to the length of the side wall of the inner cylinder, and a line between the two end points of the scraper blades has an included angle relative to the axis of the inner cylinder.

Further, the included angle is an acute angle or obtuse angle.

Further, the number of the scraper blades is 2-10, and the scraper blades are uniformly set along the wall of the inner cylinder.

Further, the number of the scraper blades is 5-8.

Further, an isolated cylinder with reticular structure for separating the clothes from the particles is provided on the inner side of the inner cylinder, and the bottom and the top of the isolated cylinder are respectively connected fixedly with the bottom and the top of the inner cylinder.

Further, a storage space for storing the particles is arranged in the washing machine, and the storage space is communicated with the inner cylinder.

Further, the storage space for storing the particles is an extension part extending from one side of the inner cylinder, a baffle for blocking clothes is arranged between the storage space and the inner cylinder, and a channel for communicating the storage space with the inner cylinder each other is arranged between the circumference of the baffle and the inner wall of the inner cylinder, and the scraper blades on the inner wall of the inner cylinder extend to the inner wall of the extension part.

Further, the cross section of the scraper blades is streamline.

Another technical scheme of the invention is:

A washing method: several scraper blades which protrude inwards are obliquely arranged on inner wall of the inner cylinder of the washing machine, during the inner cylinder rotating, driving the particles to move upward or downward along the scraper blades and turn over within the inner cylinder, thus the particles mix with the clothes and the washing water and turn together, and the washing of the clothes is completed.

Further, driving the inner cylinder to continuously rotate according to the same or the opposite inclined direction of the scraper blades, the particles are driven to move to the side of the inner cylinder by the scraper blades, finishing putting the particles; or the particles are driven to move away from the inner cylinder by the scraper blades, finishing recycling the particles.

Further, during washing the clothes, putting and recycling the particles, the rotation speed of the inner cylinder and the extension part is 50-150 r/min.

Further, the storage space for storing the particles is the extension part extending from one side of the inner cylinder, the scraper blades on the inner wall of the inner cylinder extend to the inner wall of the extension part, the extension part and the inner cylinder rotate synchronously, and the particles are driven to move away from the inner cylinder by the scraper blades and be recycled to the storage space.

Further, after the particles are recycled to the extension part, or before the particles are recycled to the extension part, or when the particles are recycled to the extension part, the inner cylinder and the extension part of the inner cylinder rotate with the speed of 100-1000 r/min, thus the particles move to the extension part, and realize the process of dehydration of the particles and the clothes at the same time.

Therefore, the washing machine and washing method in the invention compared with the prior arts has the following advantages:

(1) The inner wall of the inner cylinder is provided with the scraper blades that are bent along the wall of the inner cylinder. Driven the alternating positive and reverse rotation of the inner cylinder, the clothes and the particles flip in all directions, back-and-forth and up-and-down in the inner cylinder, thus allowing more fully mixing clothes with the particles 8, also improving cleaning rate.

(2) Driven the continuously positive and reverse rotation of the inner cylinder, the particles move obliquely upward or downward along the scraper blades, and then realize putting and recovery of the particles.

(3) After the particle is completely recovered to the storage space, the inner cylinder rotates with high speed, realizing the dehydration of the clothes and the particles at the same time.

(4) The invention not only simplifies the structure of washing machine and the washing procedures, but also is beneficial to the recovery of particles to 100%.

DESCRIPTION OF DRAWINGS

As shown in FIGS. 1 to 4: 1. an outer cylinder, 2. an inner cylinder, 3. an opening hole, 4. a driving device, 5. clothes, 6. a scraper blade, 7. an included angle, 8. particles, 9. an isolated cylinder, 10. a storage space, 11. a baffle, 12. an opening, 13. a lifting block, 14. connecting plates.

EMBODIMENTS

The invention is described further with the specific embodiment in company with the drawings.

Embodiment 1

Figure 1:
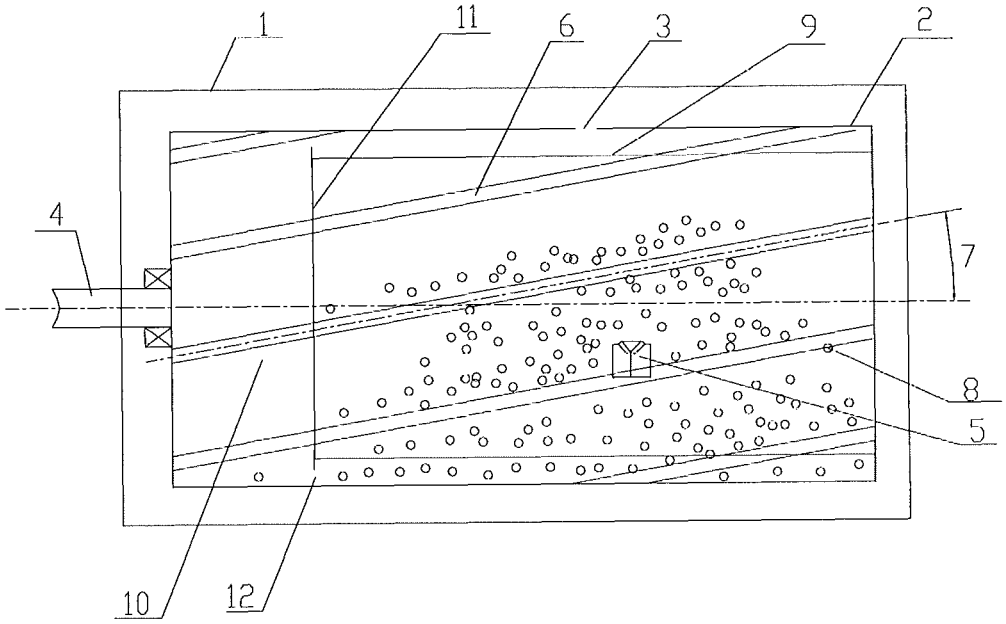
FIG. 1 is a schematic diagram of the structure of the present invention.
Figure 2:
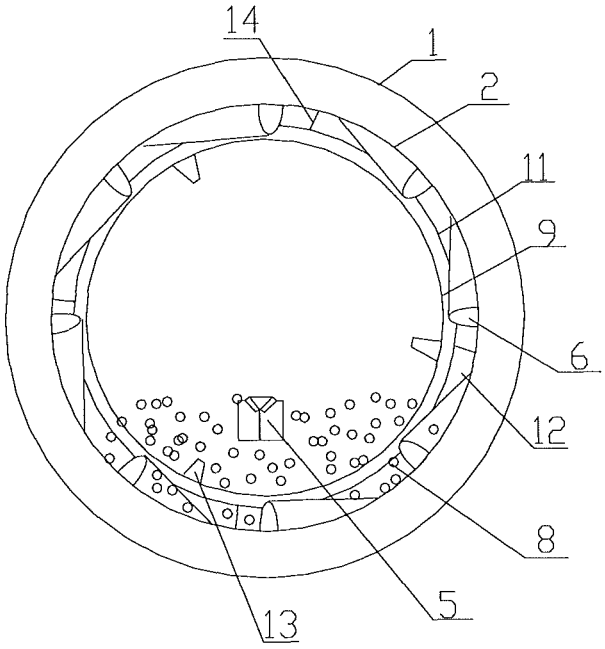
FIG. 2 is the A-A sectional view of FIG. 1.

As shown in FIG. 1 and FIG. 2, a washing machine, taking a drum washing machine for example to be further described in the embodiment, includes a housing (not shown in figure), an outer cylinder 1 arranged in the housing, an inner cylinder 2 and solid particles 8 as washing medium. Among them, the outer cylinder 1 is fixed without rotation, mainly used for holding water; the inner cylinder 2 is used for washing. The inner cylinder 2 is arranged in the outer cylinder 1. The side wall of the inner cylinder 2 is uniformly provided with a plurality of opening holes 3 through which washing water pass. The diameter of the opening holes 3 is smaller than the diameter of the solid particles 8, and the shape of the opening holes 3 can be round, rectangle, polygon etc. The inner cylinder 2 is driven to rotate by the driving device 4. The upper of the outer cylinder 1 is provided with a water inlet (not shown in figure) for adding water during the washing and rinsing process. The lower of the outer cylinder 1 is provided with a water outlet (not shown in figure) for drainage after dehydration. In washing, the clothes 5 are placed inside the inner cylinder 2.

Scraper blades 6 which protrude inwards are arranged in parallel on the inner wall of the inner cylinder 2. The scraper blades 6 are aslope arranged on the wall of the inner cylinder, and are bent along the circular arc of the wall of the inner cylinder. The line between the two end points of the scraper blades 6 has an included angle 7 relative to the axis of the inner cylinder 2. The scraper blades 6 rotates with the inner cylinder, and drives the solid particles 8 as washing medium to move aslope upwards or downwards along the scraper blades 6. When moving to a certain height, the particles 8 drop into the inner cylinder 2 from the scraper blades 6 to realize the turnover. The inclined direction of the scraper blades 6 incline upwards as shown in FIG. 1, and the included angle 7 is an acute angle. The inclined direction of the scraper blades 6 also can incline downwards, and the included angle 7 is an obtuse angle. In the embodiment, as shown in FIG. 1, the included angle 7 takes an acute angle as an example.

In order to separate the clothes 5 from the particles 8 conveniently, an isolated cylinder 9 in which the clothes 5 are placed is provided along the inner side of the inner cylinder 2. The bottom and the top of the isolated cylinder 9 are respectively connected fixedly with the bottom and the top of the inner cylinder 2 by fastener. The isolated cylinder 8 and the inner cylinder 2 rotate synchronically. The isolated cylinder 9 is reticular structure, so that the particles 8 and the washing water flow into or out easily. The clothes 5 are isolated in the isolated cylinder 9, and the particles 8 are isolated between the isolated cylinder 9 and the inner cylinder 2. In washing, the particles 8 pass through the isolated cylinder 9 and mix with the clothes 5 fully. The particles 8 preferably employ polymer material with porous on the surface. The dirt of the clothes 5 and the wash water are adsorbed by utilizing the good adsorption ability of the particles 6 to achieve better washing effect.

In the embodiment, the cross section of the scraper blades 6 is preferably streamline shape which is roughly circular arc in shape, so that it is avoid to damaging the particles. The diameter of the particles 8 is about in the range of 2-3 mm, so the height of the scraper blades 6 is greater than or equal to 5 mm, the height of the scraper blades 6 slightly lower than or equal to the distance between the inner wall of the inner cylinder 2 and the outer wall of the isolated cylinder 9. The number of the scraper blades 6 is 2-10, preferably 5-8. As shown in FIG. 2, in the embodiment, the number of the scraper blades 6 is 8, which are uniformly set along the inner wall of the inner cylinder 2. The more the number of the scraper blades 6 is and the greater the height of the scraper blades 6 is, the larger the number of the particles 8 driven by the scraper blades 6 is, thus the pushing speed for driving the particles 8 is higher. It is not only more conducive for putting and recycling the particles, but also helpful to mix the particles 8 with the clothes, further improving the cleaning efficiency.

As with the common drum washing machine, the inner wall of the inner cylinder 2 is provided with at least one lifting block 13 which is projecting inwardly. In the process of washing, driven by the lifting block 13, the clothes 5 is continually turned up and down in the inner cylinder 2 and lifted, and then falls cyclically to achieve the effect of washing. The number of the lifting blocks 13 is 1-3, in the embodiment, preferably three lifting blocks 13 which is distributed circumferentially and uniformly along the inner cylinder 2. At the same time, the inner cylinder 2 rotates alternately positively and reversely. Driven by the scraper blades 6 on the wall of the inner cylinder 2, the particles 8 move and flip along the direction of the axis of the inner cylinder 2 forward and backward. Thus the clothes 5 are more fully mixed with the particles 8 to improve the cleaning rate.

A storage space 10 for storing the particles 8 is set in the washing machine. The storage space 10 is an extension part of the inner cylinder 2 extending from one side. As with the inner cylinder 2, the extension part is provided with opening holes 3 through which the washing water only pass. The extension part and the inner cylinder 2 are driven to synchronously rotate by the driving device 4. The scraper blades 6 on the inner wall of the inner cylinder 2 extend to the inner wall of the extension part. In the embodiment, the storage space 10 is the same shape with the inner cylinder 2, such as cylindrical, or circular. Of course, the inner cylinder 2 can also extend from the top, so the storage space 9 is provided on the top of the inner cylinder 2. In order to put and take off the clothes 5 conveniently, the storage space 10 is circular.

The storage space 10 is communicated with the inner cylinder 2, and a baffle 11 for blocking clothes is arranged between the storage space 10 and the inner cylinder 2. The baffle 11 is located on radial center of the inner cylinder 2, and connects fixedly with the side wall of the inner cylinder through a plurality of connecting plates (not shown in figure). A channel 12 for communicating the storage space 10 with the inner cylinder 2 each other is arranged between the circumference of the baffle 11 and the inner wall of the inner cylinder 2. The baffle 11 prevents the clothes 5 from going into the storage space 10, but the particles 8 can go in and out the storage space 10 through the channel 12.

During the inner cylinder 2 rotating, the particles 8 move obliquely upward or downward along the scraper blades 6 under the action of centrifugal force. The rotation speed of the inner cylinder 2 has no need to be very high; the washing speed can be realized. Generally the rotation speed is 50-150 r/min.

When the rotation direction of the inner cylinder 2 and the extension part is opposite to the inclined direction of the scraper blades 6, and operating continuously along the direction, the particles 8 are driven to move obliquely upward to the inner cylinder 2 direction by the scraper blades 6, and go in the inner cylinder 2 through the channel 12. Thus the process of putting the particles 8 in the inner cylinder 2 is finished.

When the rotation direction of the inner cylinder 2 and the extension part is same with the inclined direction of the scraper blades 6, and operating continuously along the direction, the particles 8 are driven to move obliquely downward to the storage space 9 by the scraper blades 6, leave the inner cylinder 2 through the channel 12, and go in the storage space 10. Thus the process of recycling the particles 8 is finished.

In the recycling process, most of the particles 8 are recycled in the storage space 10. The inner cylinder 2 and the extension part rotate with high-speed, generally the rotation speed is 100-1000 r/min, and the rotation direction of the inner cylinder 2 and the extension part is same with the scraper blades 6. The clothes 5 in the inner cylinder 2 and the particles 8 in the storage space 10 dewater simultaneously to realize the recycling of the particles 8. In the process of the dehydration, the residual particles 8 can continue to be separated and recycled, to achieve 100% recycling rate of the particles.

If the storage space 10 is arranged on one side of the top of the inner cylinder 2, the rotation direction of the inner cylinder 2 is opposite to the foregoing during putting and recycling the particles 8.

In the process of washing, the inner cylinder 2 is operating positive and reversely alternately. Driven by the scraper blades 6, the particles 8 move forward and backward continuously in the inner cylinder 2. The particles 8 move along the scraper blades 6 obliquely upward or obliquely downward alternately, to a certain height, the particles 8 fall into the inner cylinder 2 from the scraper blades 6. Thus it is achieved to flipping.

The following describes in detail the washing method of the drum washing machine in company with FIGS. 1-4.

The washing method includes the following steps:

Step 1: putting the clothes 5 into the isolated cylinder 9 of the washing machine, and opening the water inlet at the top of the outer cylinder 1, adding water mixed with the detergent into the outer cylinder 1, fully mixing the water with the clothes 5 in the isolated cylinder 8 after the water passes through the opening holes 3 of the inner cylinder 2 and the isolated cylinder 8. In the process, the amount of the added water and detergent only need to ensure to soak the clothes 5 in the water.

During adding the washing water to soak the clothes to be washed, the clothes is soaked for a certain time for fully wetting the clothes, and further the cleaning effect is improved.

Figure 3:
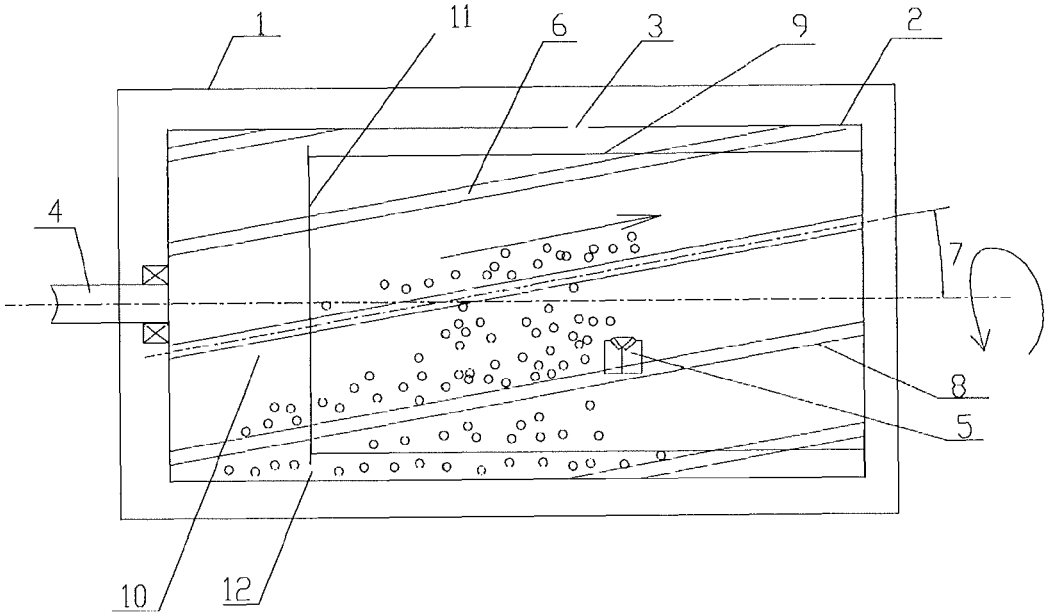
FIG. 3 is a schematic diagram of the putting process of the particles in the present invention.

Step 2: as shown in FIG. 3, driving the inner cylinder 2 to rotate, the rotation direction of the inner cylinder 2 and the extension part is opposite to the direction of the scraper blades 6, and operating continuously along the direction. The particles 8 close to the wall of the inner cylinder 2 under the action of centrifugal force, and are driven to move obliquely upward to the inner cylinder 2 by the scraper blades 6, and go in the inner cylinder 2 through the channel 12. Thus the process of putting the particles 8 in the inner cylinder 2 is finished.

In the process of putting the particles 8, the particles 8 in the inner cylinder 2 are driven continually flip by the scraper blades 6, and mix fully with clothes 5.

In this step, the rotation speed of the inner cylinder 2 is preferably 100-150 r/min.

Step 3: as shown in FIG. 1, all of the particles 6 are put into the inner cylinder 2, which can be controlled by defining the putting time. Subsequently, the driving device 4 drives the inner cylinder 2 to rotate positively for some time, and stop, and then rotate reversely for some time, the scraper blades 6 rotates positively and reversely alternately, so the particles 8 move forward and backward continuously in the inner cylinder 2. The particles 8 move obliquely upward along the scraper blades 6, to a certain height, the particles 8 turn downward and fall into the inner cylinder 2. Thus it is achieved to flip forward and backward. In the process of washing, the clothes 5 flip up and down under the action of the lifting block 13.

In the washing process, the particles 8, the clothes 5 and the washing water are fully mixed, and lifted and fallen constantly under the action of the lifting block 13. The washing of clothes is accomplished.

In this step, the rotation speed of the inner cylinder 2 is preferably 100-200 r/min.

Figure 4:
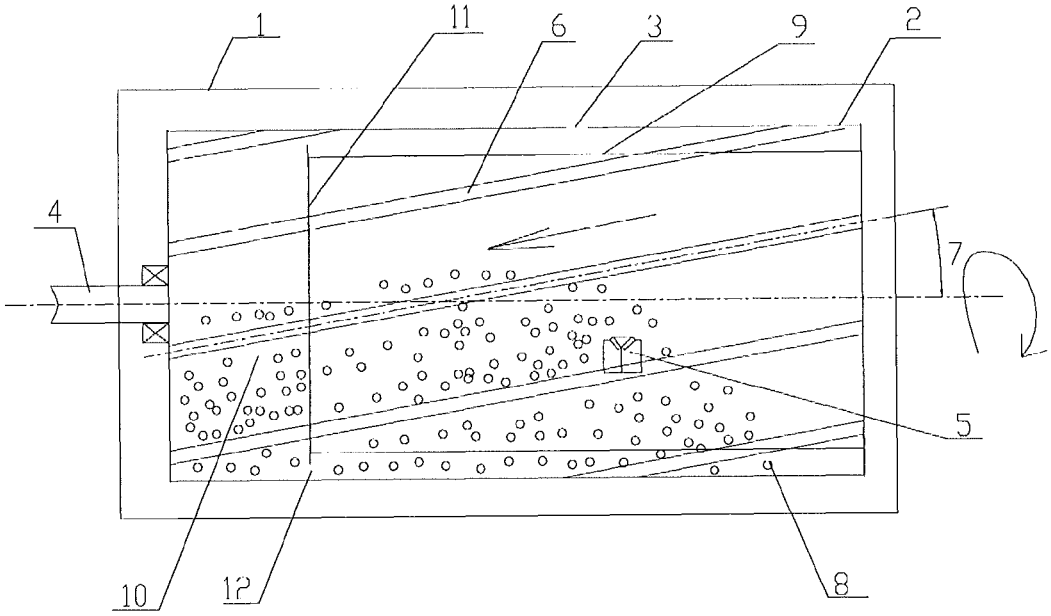
FIG. 4 is a schematic diagram of the recycling process of the particles in the present invention.

Step 4: as shown in FIG. 4, after washing, the inner cylinder 2 is driven to rotate. In the process of rotation, the particles 8 are separated from the clothes 5. The rotation direction of the inner cylinder 2 and the extension part is same with the inclined direction of the scraper blades 6, and operating continuously along the direction. The particles 8 close to the wall of the inner cylinder 2 under the action of centrifugal force, and are driven to move obliquely downward to the storage space 10 by the scraper blades 6. The particles are separated continually through the channel 12, and leave the inner cylinder 2 and go into the storage space 10. The process of recycling the particles 8 to the storage space 10 is finished.

In the step, the rotation speed of the inner cylinder 2 is preferably 100-150 r/min.

Step 5: after the particles 8 are separated for the clothes 5 and recycled, the inner cylinder 2 rotates with high speed. The clothes 5 in the inner cylinder 2 and the particles 8 in the storage space 10 dewater simultaneously to recycle the particles 8. The water is collected in the outer cylinder 1 and discharged from the water outlet at the bottom of the outer cylinder 1. In the process, the rotation direction of the inner cylinder 2 and the extension part is same with the inclined direction of the scraper blades 6. The residual particles 8 can continue to be separated and recycled, to achieve 100% recycling rate of the particles.

In this step, the rotation speed of the inner cylinder 2 is 100-1000 r/min, generally higher than the washing speed.

Step 6: the rinsing step, adding appropriate amount of clean water to the outer cylinder 1 again, rinsing the clothes 5 according to the above mentioned process. At this time, the clean water also goes into the storage space 10. Both the clothes 5 and the particles 8 are rinsed simultaneously. Then dewater is operated again after rinsing. The few particles 8 is separated and recovered, the whole washing process is finished.

Embodiment 2

The difference from Embodiment 1 is that step 5 in Embodiment 1 is performed firstly. The inner cylinder 2 and the extension part are driven to rotate with high-speed, and the rotation direction of the inner cylinder 2 and the extension part is same with the inclined direction of the scraper blades 6. The clothes 5 and the particles 8 dewater. During dewatering, it is realized to separate the clothes 5 from the particles 8. At the same time, parts of the particles 8 is driven to move obliquely downward to the storage space 10 by the scraper blades 6, return to the storage space 10.

Then step 4 in Embodiment 1 is performed. The inner cylinder 2 and extension part are driven to rotate with the washing rotation speed. The rotation direction of the inner cylinder 2 and the extension part is same with the inclined direction of the scraper blades 6, and operating continuously along the direction, so that the residual particles 8 can continue to be separated and recycled, to be recycled by recycling rate 100%.

Embodiment 3

The difference from Embodiment 1 is that step 4 in embodiment 1 is deleted and directly performing step 5 in Embodiment 1. The inner cylinder 2 and extension part are driven to rotate with high speed, and the rotation direction of the inner cylinder 2 and the extension part is same with the inclined direction of the scraper blades 6. The clothes 5 and the particles 8 dewater. During dewatering, it is realized to separate the clothes 5 from the particles 8. At the same time, the particles 8 are driven move obliquely downward to the storage space 10 by the scraper blades 6, return to the storage space 10. In the process, the time for the rotation of the inner cylinder 2 with high speed is needed to be lengthened, to ensure that the particles 8 is completely recovered to the storage space 10.

Embodiment 4

The difference from Embodiment 1 is that the storage space is a storage box structure, which is arranged on the outside wall of the outer cylinder 1. The storage space 10 is connected with the inner cylinder 2 directly through the wall of the outer cylinder 1. The communicating hole between the storage space 10 and the inner cylinder 2 is arranged on the end position of the inner cylinder 2.

After washing, the inner cylinder 2 is driven to rotate. In the process of rotation, the particles 8 are separated from the clothes 5. Meanwhile, the rotation direction of the inner cylinder 2 and the extension part is same with the inclined direction of the scraper blades 6, and operating continuously along the direction. The particles 8 are driven to move obliquely downward to the storage space 10 by the scraper blades 6, and go in the storage space 10 through the communication hole. The particles 8 are isolated constantly, and leave the inner cylinder 2 and go in the storage space 10. Thus the process of recycling the particles 8 to the storage space 10 is complete.

Embodiment 5

The difference from the above four Embodiments is that the inclined direction of the scraper blades 6 is opposite. The angle formed by the line between the two end points relative to the axis of the inner cylinder is an obtuse angle. In this case, the rotation directions of the inner cylinder in the process of putting and recycling of the particles 8 are opposite to with the directions of the above embodiments.

In the process of putting the particles 8, the rotation direction of the inner cylinder 2 and the extension part is same with the inclined direction of the scraper blades 6, and operating continuously in the direction. The particles 8 are driven to move obliquely downward to the inner cylinder 2 by the scraper blades 6 through the channel 12, and go into the inner cylinder 2. The process of putting the particles 8 in the inner cylinder 2 is finished.

In the process of recycling of the particles 8, the rotation direction of the inner cylinder 2 and the extension part is opposite to the inclined direction of the scraper blades 6, and operating continuously in the direction. The particles 8 are driven to move obliquely upward to the storage space 10 by the scraper blades 6, and be separated through the channel 12. The particles leave the inner cylinder 2 and go in the storage space 10. Thus the process of recycling the particles 8 to the storage space 10 is complete Embodiment 6

The difference from the above four Embodiments is that the scraper blades 6 are spirally set from the bottom to the top of the inner cylinder 2, not shown in figures. So, during the inner cylinder 2 rotating, the particles 8 move obliquely upward or downward and spirally along the scraper blades 6 under the action of centrifugal force. The rotation speed of the inner cylinder 2 is same with the above, and generally the rotation speed is 50-150 r/min.

When the rotation direction of the inner cylinder 2 and the extension part is same with the spiral direction of the scraper blades 6, and operating continuously along the direction, the particles 8 are driven to move obliquely upward to the inner cylinder 2 by the scraper blades 6, and go in the inner cylinder 2 through the channel 12. The process of putting the particles 8 in the inner cylinder 2 is finished.

When the rotation direction of the inner cylinder 2 and the extension part is opposite to the spiral direction of the scraper blades 6, and operating continuously along the direction, the particles 8 are driven to move obliquely downward to the storage space 10 by the scraper blades 6, and leave the inner cylinder 2 through the channel 12 and go in the storage space 10. The process of recycling the particles 8 to the storage space 10 is finished.

In the recycling process, most of the particles 8 are recycled to the storage space 10. Meanwhile, the inner cylinder 2 and the extension part rotate with high-speed. Generally the rotation speed is 100-1000 r/min. The rotation direction of the inner cylinder 2 and the extension part is opposite to the spiral direction of the scraper blades 6. The clothes 5 in the inner cylinder 2 and the particles 8 in the storage space 10 dewater simultaneously to realize the recycling of the particles 8. In the process of the dehydration, the residual particles 8 can continue to be separated and recycled, to achieve 100% recycling rate of the particles.

In the process of washing, the inner cylinder 2 is operating positively and reversely alternately. Driven by the scraper blades 6, the particles 8 move forward and backward continuously in the inner cylinder 2. The particles 8 move obliquely upward or obliquely downward along the scraper blades 6 alternately. To a certain height, the particles 8 turn downward and fall into the inner cylinder 2 from the scraper blades 6, achieving flipping.

As mentioned above, the described scheme in company with the figures can be derived similar technical scheme. But the schemes that are not out of the technical scheme of the invention, and any simple modification, equal transformation and modification of the examples said above, on the basis of the essence of the invention are still belongs to the scope of the technical scheme of the invention.

The invention claimed is:

1. A washing machine, comprising an inner cylinder, an outer cylinder, and solid particles as washing medium, the inner cylinder being driven to rotate by a driver device, wherein, scraper blades which protrude inwards and are bent along an inner wall of the inner cylinder are arranged on the inner wall of the inner cylinder, the scraper blades drive the particles to move and turn over obliquely upward or downward, an isolated cylinder with reticular structure configured to separate clothes from the particles is arranged along an inner side of the inner cylinder, a storage space configured to store the particles is arranged in the washing machine, and the storage space communicates with the inner cylinder, the storage space configured to store the particles is an extension part of the inner cylinder extending from one side of the inner cylinder, a baffle is configured to block clothes between the storage space and the inner cylinder, a channel between the storage space and the inner cylinder is arranged between a circumference of the baffle and an inner wall of the inner cylinder, and the scraper blades on the inner wall of the inner cylinder extend to the inner wall of the extension part.

2. The washing machine according to claim 1, wherein, the scraper blades are spirally set from a bottom to a top of the inner cylinder.

3. The washing machine according to claim 1, wherein, a plurality of scraper blades are arranged in parallel, a projected length of the scraper blades along an axial direction of the inner cylinder is equal to the length of a side wall of the inner cylinder, and a line between two end points of the scraper blades has an included angle relative to an axis of the inner cylinder.

4. The washing machine according to claim 3, wherein, the included angle is an acute angle or obtuse angle.

5. The washing machine according to claim 3, wherein, the number of the scraper blades is 2-10, and the scraper blades are uniformly set along the wall of the inner cylinder.

6. The washing machine according to claim 5, wherein, the number of the scraper blades is 5-8.

7. The washing machine according to claim 1, wherein a bottom and a top of the isolated cylinder are respectively connected fixedly with a bottom and a top of the inner cylinder.

8. The washing machine according to claim 1, wherein, a cross section of the scraper blades is streamline.

9. A washing method for use with the washing machine according to claim 1, wherein, several scraper blades which protrude inwards are obliquely arranged on the inner wall of the inner cylinder of the washing machine, during the inner cylinder rotating, driving the particles to move obliquely upward or downward along the scraper blades and turn over within the inner cylinder, the particles mix with clothes and washing water and turn together, and washing of the clothes is completed.

10. The washing method according to claim 9, wherein, driving the inner cylinder to continuously rotate in a same or an opposite inclined direction of the scraper blades, the particles are driven to move to a side of the inner cylinder by the scraper blades, finishing putting the particles; or the particles are driven to move away from the inner cylinder by the scraper blades, finishing recycling the particles.

11. The washing method according to claim 9, wherein, during washing the clothes, putting and recycling the particles, a rotation speed of the inner cylinder and the extension part is 50-150 r/min.

12. The washing method according to claim 10, wherein, the scraper blades on the inner wall of the inner cylinder extend to the inner wall of the extension part, the extension part and the inner cylinder rotate synchronously, and the particles are driven to move away from the inner cylinder by the scraper blades and are recycled to the storage space.

13. The washing method according to claim 12, wherein, after the particles are recycled to the extension part, or before the particles are recycled to the extension part, or when the particles are recycled to the extension part, the inner cylinder and the extension part of the inner cylinder rotate with a speed of 100-1000 r/min, the particles move to the extension part, and realizing the process of dehydration of the particles and the clothes at the same time.

* * * * *